US006092257A

United States Patent [19]

Chen

[11] Patent Number: 6,092,257

[45] Date of Patent: Jul. 25, 2000

[54] BATH BALL

[75] Inventor: Kuo-Chin Chen, Taipei, Taiwan

[73] Assignee: Confirm Personal Care Industrial Corp., Taoyuan Hsien, Taiwan

[21] Appl. No.: 09/196,888

[22] Filed: Nov. 20, 1998

[51] Int. Cl.[7] ..... A47K 7/02

[52] U.S. Cl. ..... 15/209.1; 15/229.11

[58] Field of Search ..... 15/209.1, 210.1, 15/222, 229.11, 229.12, 229.13

[56] References Cited

U.S. PATENT DOCUMENTS

| | | | |
|---|---|---|---|
| 1,737,247 | 11/1929 | Kean | 15/229.11 |
| 3,343,196 | 9/1967 | Barnhouse | 15/229.11 |
| 4,462,135 | 7/1984 | Sanford | 15/229.12 |
| 5,727,277 | 3/1998 | Chien | 15/209.1 |
| 5,727,278 | 3/1998 | Per-Lee | 15/209.1 |
| 5,850,662 | 12/1998 | Galva-Garza | 15/209.1 |
| 5,937,472 | 8/1999 | Girardot et al. | 15/209.1 |
| 5,947,564 | 9/1999 | Chen | 15/209.1 |

*Primary Examiner*—Terrence R. Till

*Attorney, Agent, or Firm*—Pro-Techtor International Services

[57] ABSTRACT

Disclosed is a bath ball formed from at least two long sleeves of elastic nets woven out of different artificial fibers. The nets are sequentially put around a mold and axially compressed inward from two ends layer by layer to produce a multi-layer ruffled body on the mold. The ruffled body is tightened at two diametrically opposite points and removed from the mold, forming a bath ball having naturally spread dense ruffles. The dense ruffles give the bath ball better ability to hold sufficient bubbles to facilitate convenient and effective body cleansing. Moreover, the bath ball includes artificial fibers having different degrees of coarseness and can therefore be used to properly clean different body areas.

3 Claims, 10 Drawing Sheets

BATH BALL

BACKGROUND OF THE INVENTION

The present invention relates to an improved bath ball, and more particularly to a bath ball including at least two types of artificial fibers to provide more than two different surface coarseness to achieve thorough body cleaning.

There are various kinds of body cleansing means available in the market of bathing supplies. Apart from common body cleansers and perfumed soaps, there are still many body cleansing tools, such as bath towels, back brushes, bath balls, bath sponges, etc. These tools are applied with body cleanser or soap and used to scrub and therefore clean skin.

Please refer to FIG. 1 that shows a conventional bath ball. To make such conventional bath ball, an elastic net in the form of long sleeve woven out of one type of artificial fibers is put around a mold. The long sleeve is axially compressed along the mold from two ends toward a middle point thereof, so that a ring-shaped ruffled body 1 is formed on the mold. Then, two diametrically opposite points on the ruffled body 1 are tightened with fastening means 2. After the ruffled body 1 is removed from the mold and released, its ruffled outer periphery loosely spread out toward a center thereof, forming a spherical bath ball. Such conventional bath ball is usually made with only one type of artificial fiber and therefore has following disadvantages:

1. The bath ball provides only one degree of surface coarseness that is not always suitable for cleaning different body areas. The bath ball might be too coarse for some body areas while too fine for another areas.
2. The bath ball is formed by ruffling only one elastic sleeve and is therefore usually monotonous in color.
3. Only limited numbers of ruffles can be formed from one single elastic sleeve. The spread ruffles of the bath ball are too loose to hold sufficient body cleanser or soap liquid. Additional body cleanser or soap liquid must be added during bathing that causes inconvenience to a user.

It is therefore tried by the inventor to develop a bath ball that includes at least two types of artificial fibers to provide more than two degrees of coarseness for different body areas.

SUMMARY OF THE INVENTION

A primary object of the present invention is to provide a bath ball made of at least two types of artificial fibers to provide more than two degrees of coarseness for cleaning different body areas.

Another object of the present invention is to provide a bath ball having a ruffled body formed from multiple layers of overlaid sleeves woven out of at least two types of artificial fibers, such that the bath ball has dense ruffles to hold more soap bubbles for convenient and effective body cleansing.

To achieve the above and other objects, the bath ball of the present invention is made by weaving artificial fibers into elastic nets in the form of long sleeve, sequentially putting the long sleeves of elastic nets around a mold, axially and inward compressing the sleeves at two ends layer by layer to produce a ruffled body on the mold, tightening two diametrically opposite points on the ruffled body, removing the ruffled body from the mold and allowing its outer periphery to loosely spread to form a spherical bath ball.

The bath ball provided by the present invention is characterized in that it includes at least two layers of elastic nets sequentially ruffled from outer layer to inner layer, so that ruffles of an inner layer locate at two ends of the ruffles of an outer layer.

The bath ball provided by the present invention has dense ruffles and therefore has better ability to hold bubbles to facilitate convenient and effective body cleansing. Moreover, the ruffled body includes two or more types of materials or coarseness for cleaning different body areas. The problem of insufficient or exceeded coarseness existing in the conventional bath ball can therefore be eliminated.

BRIEF DESCRIPTION OF THE DRAWINGS

The objects, features, and performance of the present invention may be best understood by referring to the following detailed description of the preferred embodiments and the accompanying drawings, wherein.

DETAILED DESCRIPTION OF THE PREFERRED EMBODIMENTS

Figure 1:
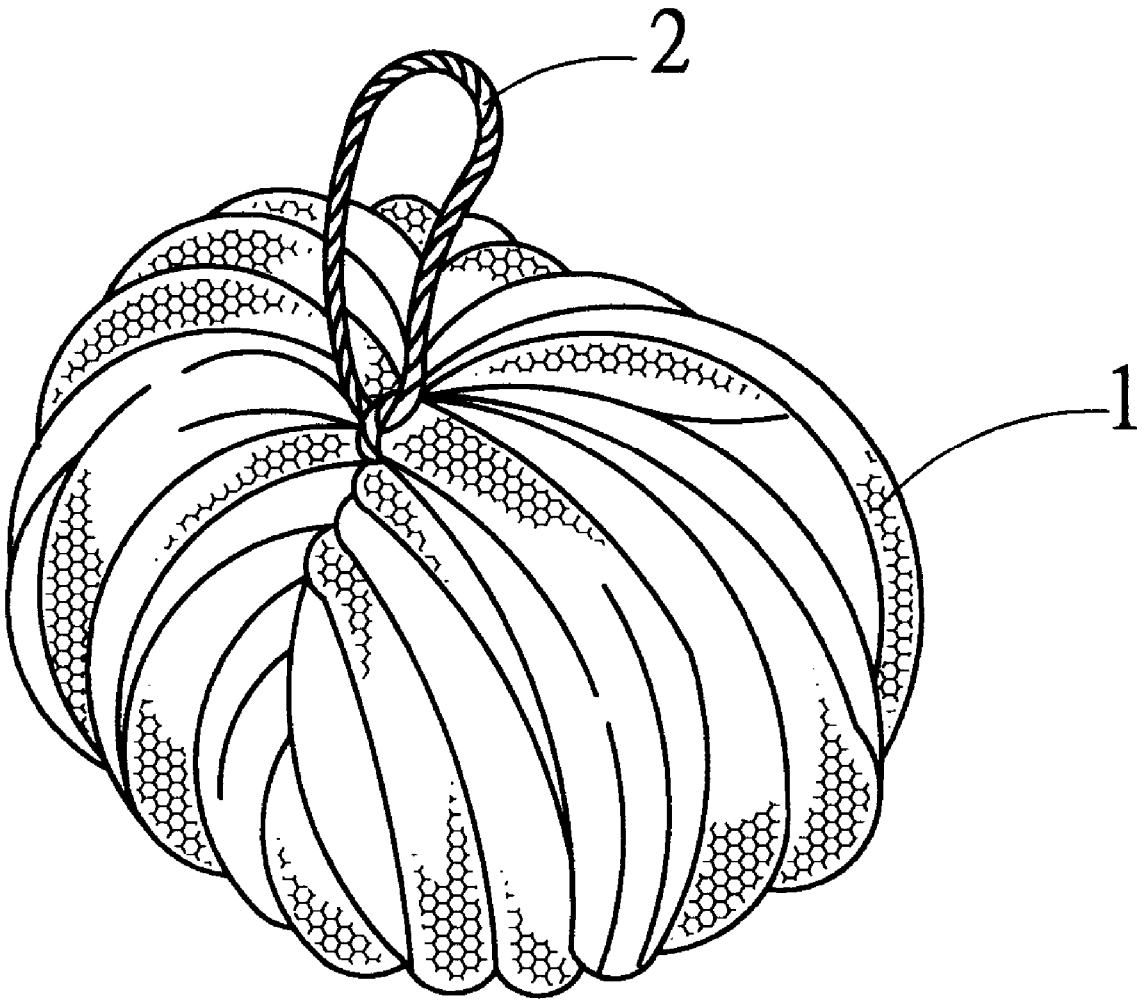
(PRIOR ART) Fig. 1
FIG. 1 is a perspective of a conventional bath ball.
Figure 2:
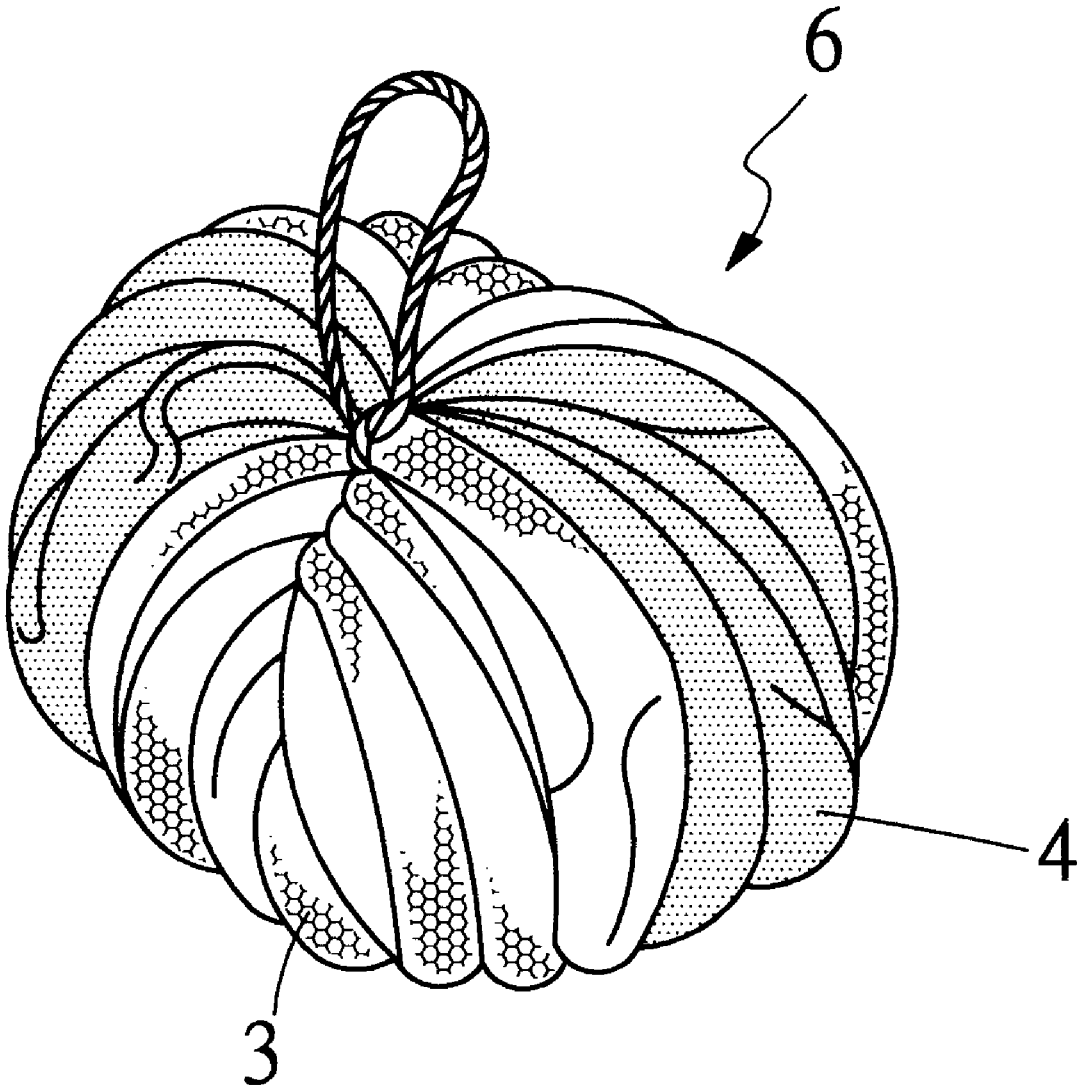
FIG. 2 is a perspective of a bath ball according to a first embodiment of the present invention.
Figure 3:
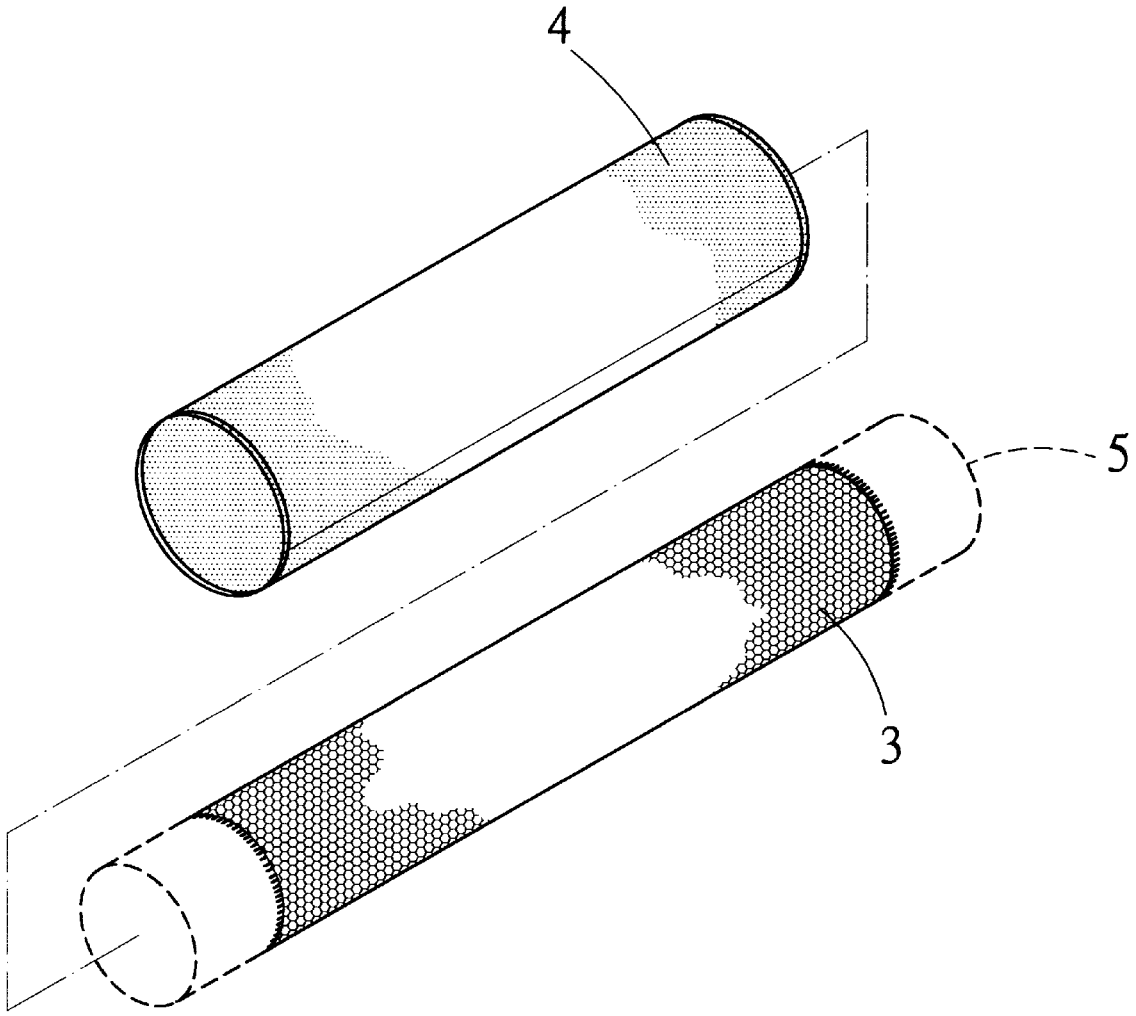
FIGS. 3 to 7 illustrate the steps for forming a ruffled body of the bath ball of FIG. 2.
Figure 4:
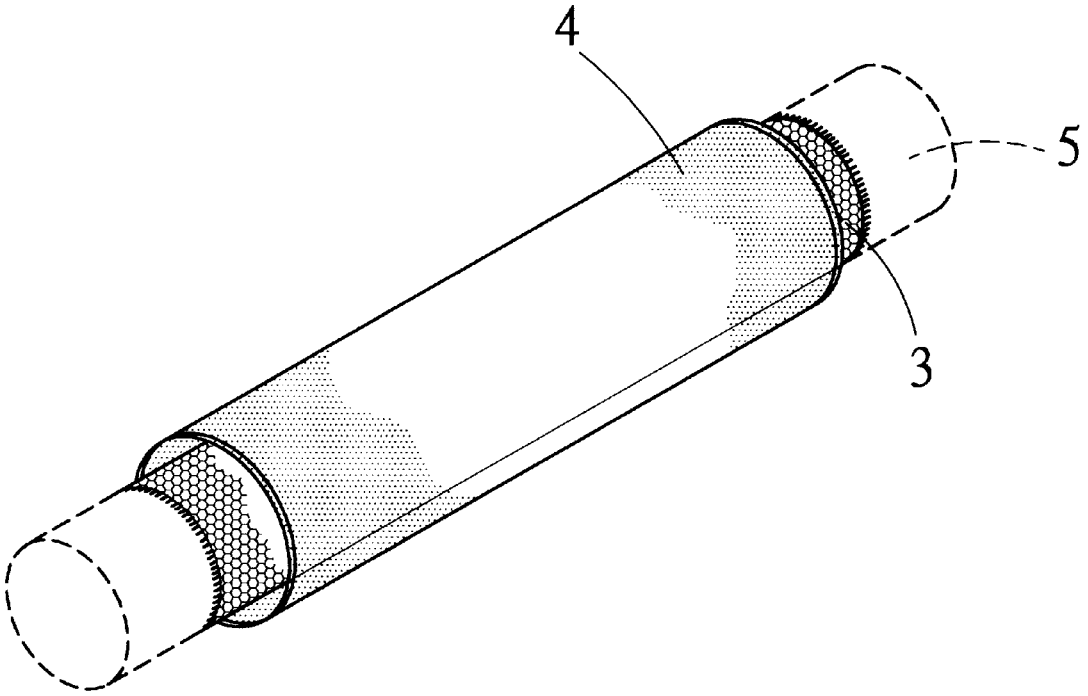
Figure 5:
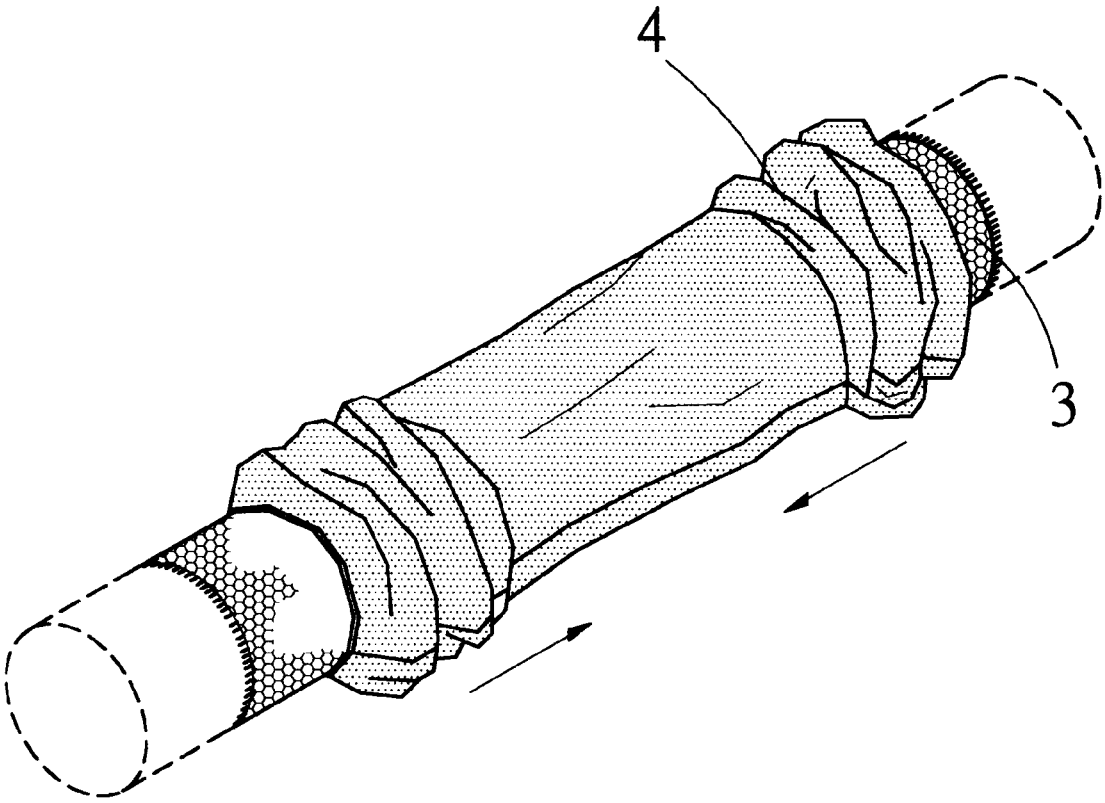
Figure 6:
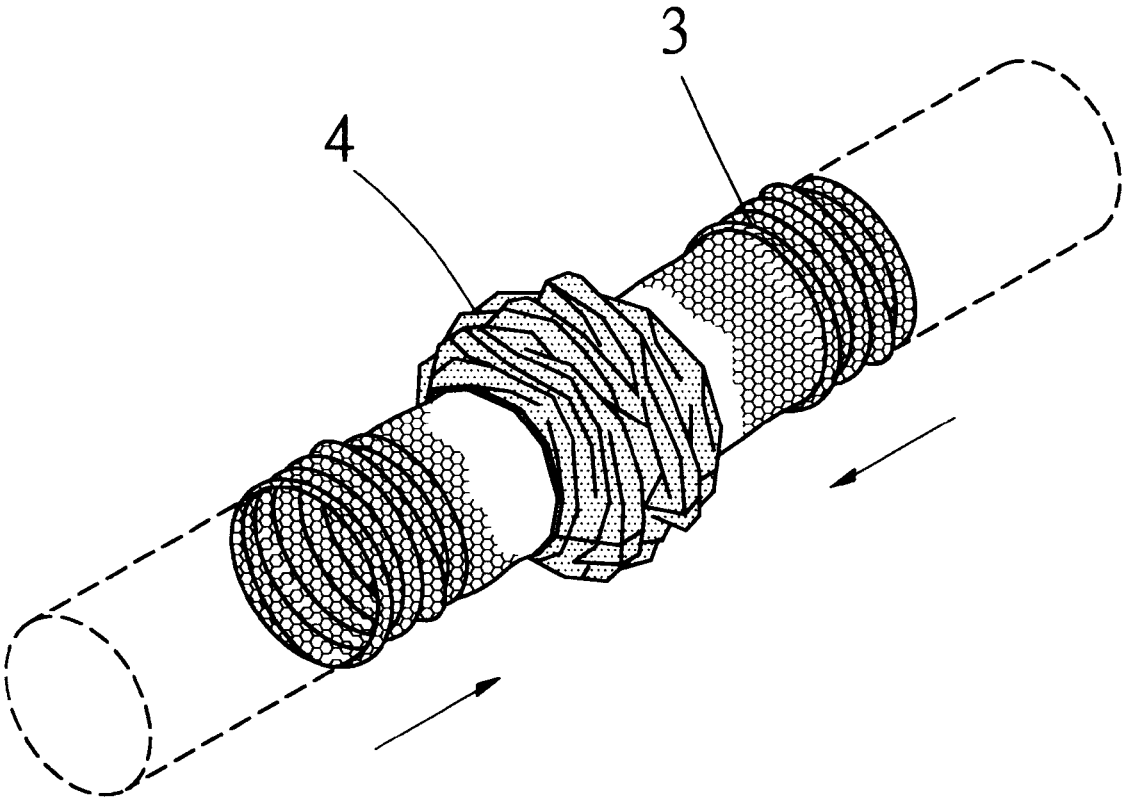
Figure 7:
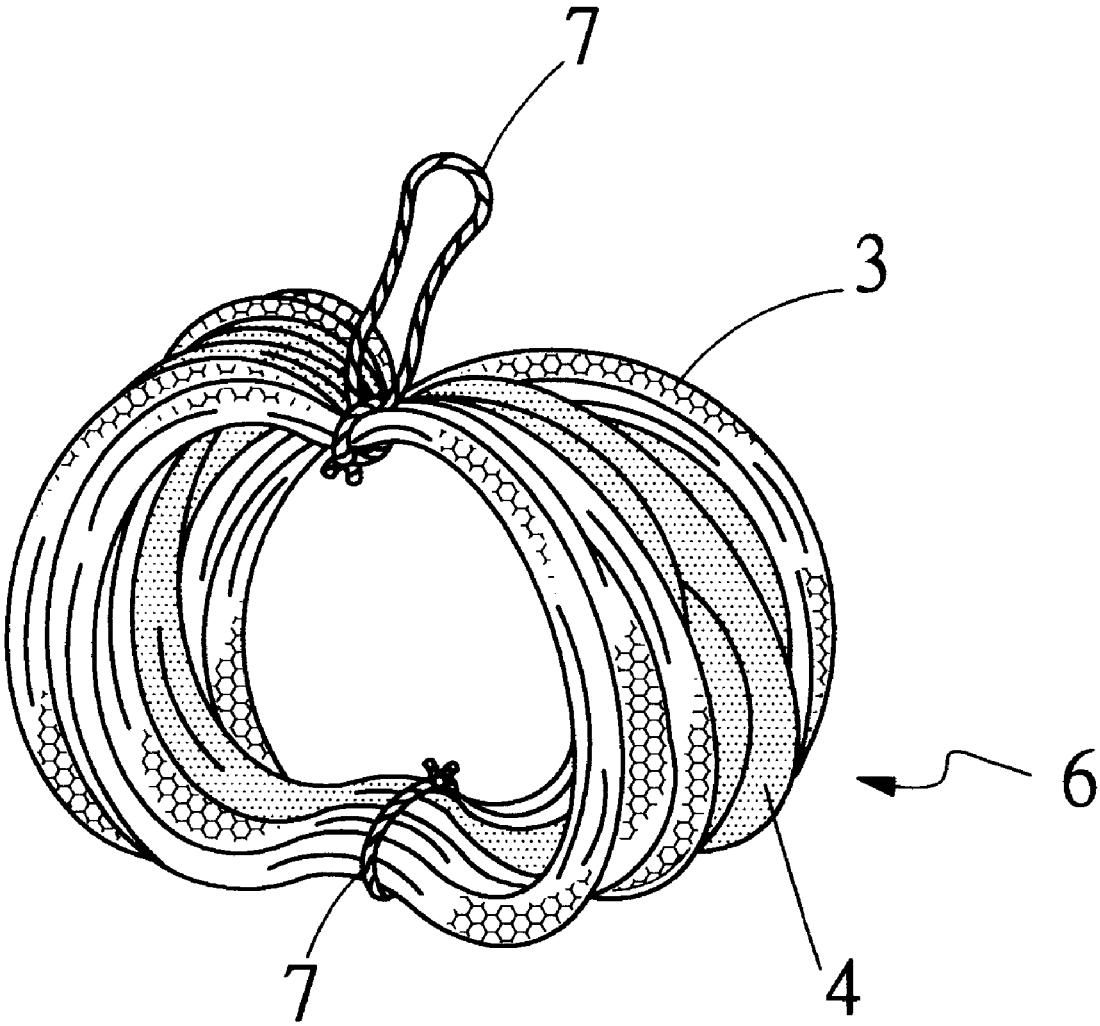

Please now refer to FIGS. 2 to 7 that illustrate steps for forming a first embodiment of the present invention. In this embodiment, the bath ball is formed from two elastic nets 3, 4 woven out of two types of artificial fibers and in a form of long sleeve. The two types of artificial fibers have different surface coarseness. The two elastic nets 3, 4 are sequentially put around a bar-like mold 5 and are axially compressed inward from two outer ends layer by layer, so that a ruffled body 6 in a form of ring is produced around the mold 5. Then, fastening means 7 are used to tighten two diametrically points on the ring-shaped ruffled body 6 together. After the ring-shaped ruffled body 6 is removed from the mold 5, an outer periphery of the ruffled body 6 naturally loosely spreads toward a center thereof to form a spherical bath ball.

Wherein the elastic nets 3, 4 are woven out of different material, such as artificial fibers and nylon filaments, and are in the form of long sleeve, as shown in FIG. 3. The two long sleeves of elastic nets 3, 4 are sequentially put around the mold 5, as shown in FIG. 4. The net 4 at outer side on the mold 5 is first compressed axially inward from two outer ends to produce a ruffled body, as shown in FIGS. 5 and 6. Then, the net 3 at inner side is also compressed axially inward along the mold 5 to produce ruffles at two outer ends of the ruffled body formed from the net 4. The ruffled nets 3 and 4 are then tightened with fastening means 7 at two diametrically opposite points to form a double-layer ruffled body 6, as shown in FIGS. 6 and 7. Finally, remove the ruffled body 6 from the mold 5. At this point, the outer periphery of the ruffled body 6 naturally loosely spreads toward the center of the ruffled body 6 to form a bath ball, as shown in FIG. 2.

Figure 8:
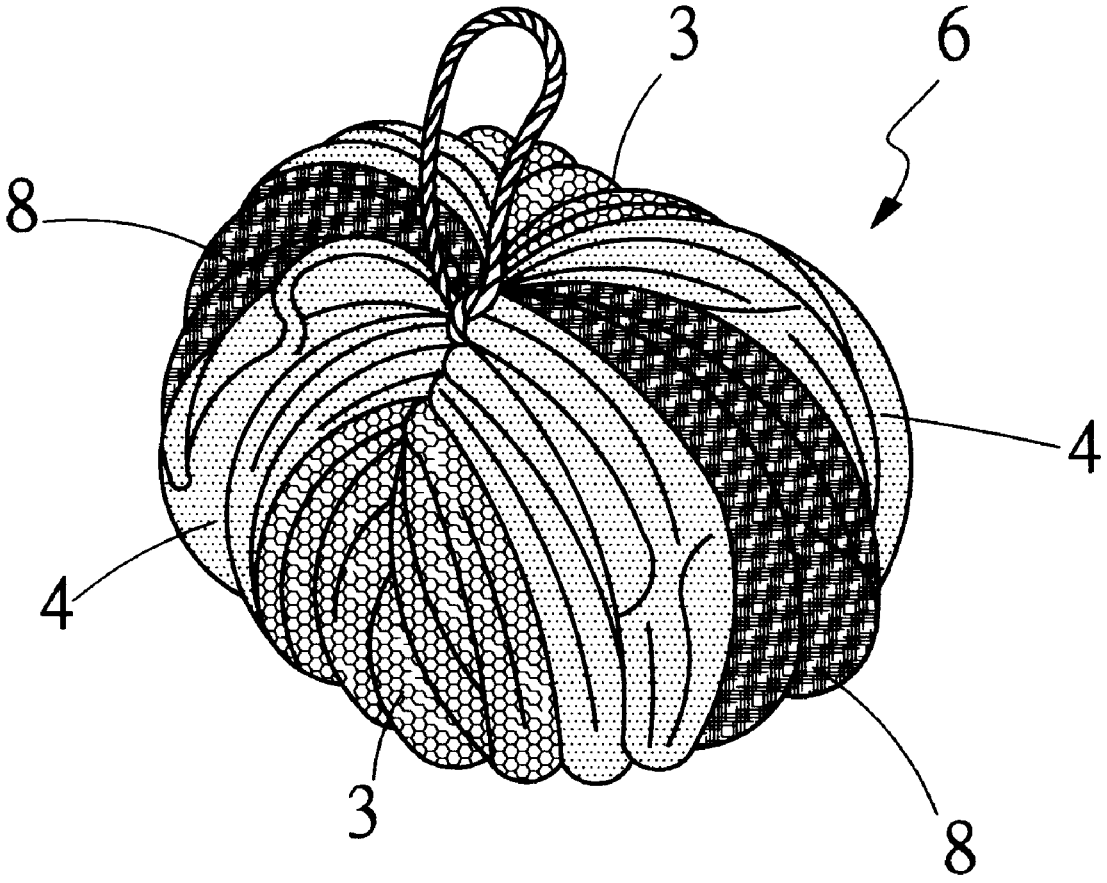
FIG. 8 is a perspective of a bath ball according to a second embodiment of the present invention.
Figure 9:
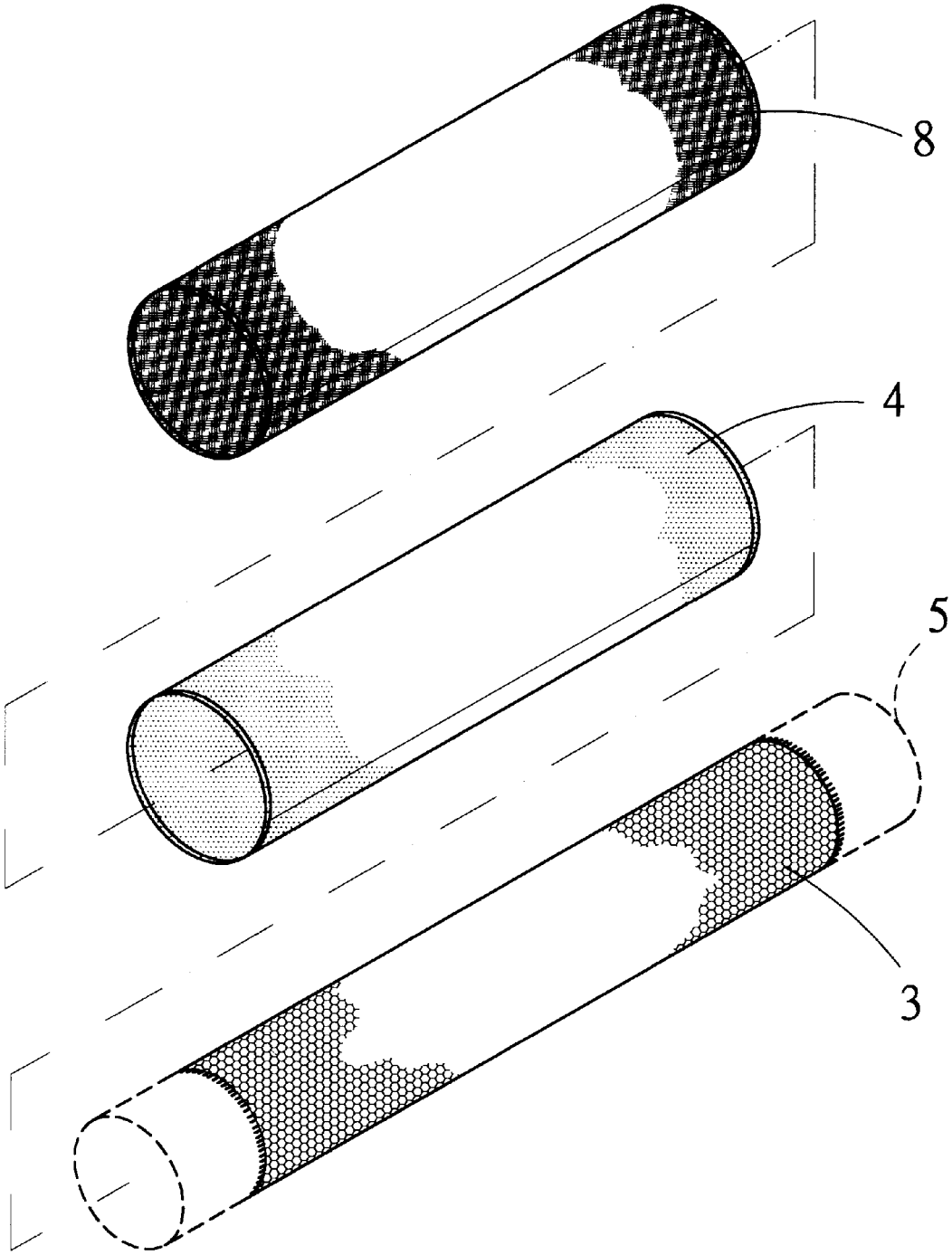
FIGS. 9 and 10 illustrate the steps for forming a ruffled body of the bath ball of FIG. 8.
Figure 10:
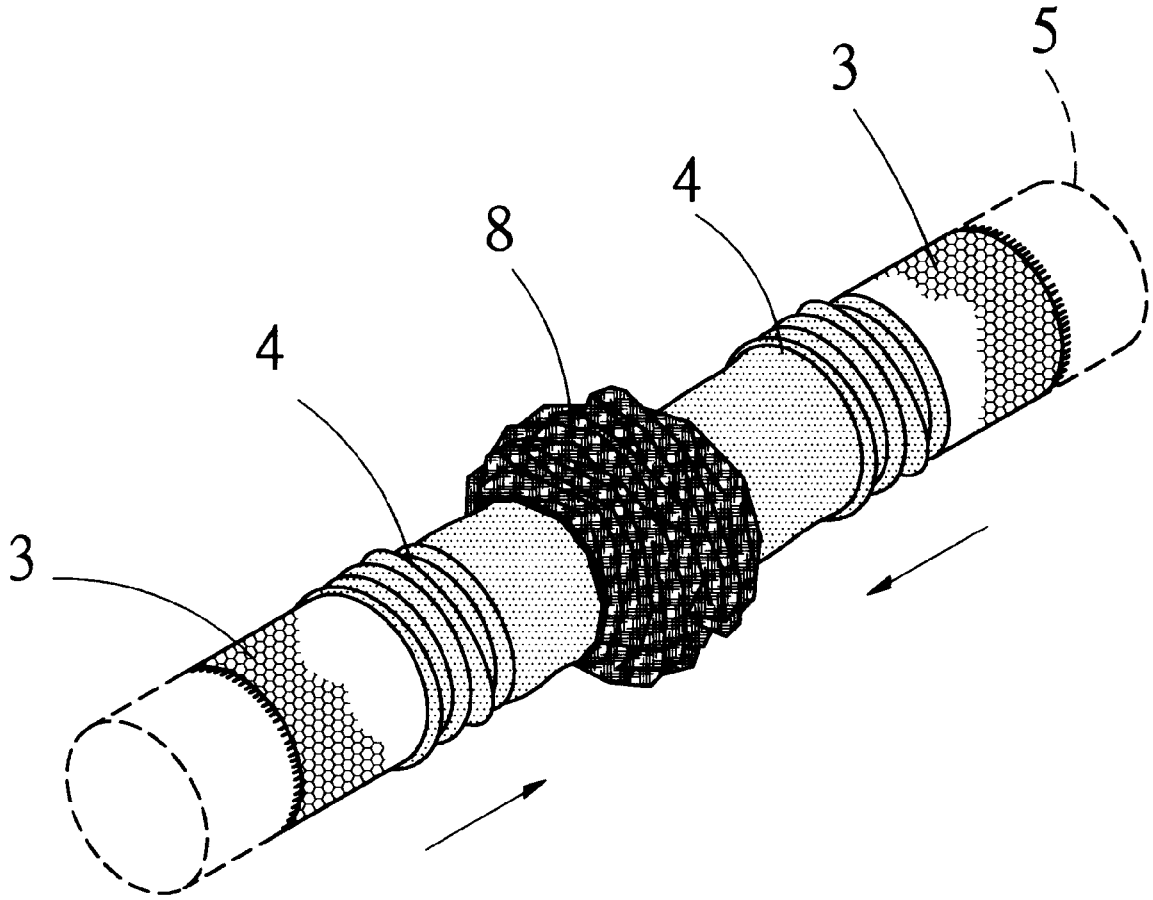

FIGS. 8 to 10 illustrate a second embodiment of the present invention. In this second embodiment, the bath ball is formed from three long sleeves of elastic nets 3, 4, and 8 woven out of artificial fibers of different surface coarseness. The elastic nets 3, 4 and 8 are sequentially put around the mold 5 in three layers. They are sequentially compressed axially inward along the mold 5 layer by layer to produce a three-layer ruffled body 6.

Fastening means 7 are then used to tighten two diametrically points on the ruffled body 6 before the ruffled body 6 is removed from the mold 5. After the ruffled body 6 is released, its outer periphery naturally spreads toward the center thereof to form a bath ball.

Wherein the three long sleeves of elastic nets 3, 4 and 8 are woven out of different materials, as shown in FIG. 9. They are sequentially put around the mold 5 in three layers. The outermost layer 8 is first axially compressed inward from two outer ends thereof to produce a ruffled body, as shown in FIG. 10. The net 4 at next layer is then compressed in the same manner to produce ruffles at two ends of the ruffled body formed from the net 8. Finally, the net 3 at innermost layer is also ruffled at two ends of the ruffled net 4 to together with the ruffled nets 4 and 8 produce a three-layer ruffled body 6 on the mold 5. Use fastening means 7 to tighten two diametrically points on the three-layer ruffled body 6 together and remove the ruffled body 6 from the mold 5. At this point, the ruffled body 6 naturally loosely spread to form a bath ball as shown in FIG. 8.

The bath ball provided by the present invention has following advantages:

1. The bath ball is formed from at least two different materials and therefore provides more than two different degrees of surface coarseness that separately suit for cleaning different body areas. A user may select a most suitable surface coarseness from one layer of the bath ball to scrub skin at different body area depending on actual need.
2. The bath ball is formed by ruffling multiple elastic nets. It is easy to use nets of different colors to give the bath ball a changeful colored appearance.
3. Multiple-layer ruffled body gives the bath ball dense ruffles for holding sufficient bubbles. Only once and reduced amount of body cleanser or soap liquid is required to apply on the bath ball to conveniently and effectively clean the body.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A bath ball comprising:

a multi-layer ruffled body comprising at least two elastic nets, said elastic nets are tubular and have different degrees of surface coarseness, each said elastic net comprises a plurality of ruffles;

said ruffles are formed by sequentially axially compressing said elastic nets such that ruffles of both elastic nets are exposed on an outer surface of said bath ball, said elastic nets are secured in a compressed position with securing means such that said nets form a substantially spherical object.

2. A bath ball as claimed in claim 1, wherein:

a first one of said elastic nets is formed from a first material, and a second one of said elastic nets is fromed from a second material.

3. The bath ball as claimed in claim 1, wherein:

said at least two elastic nets are multi-colored.

* * * * *